US007868548B2

(12) United States Patent
Bae et al.

(10) Patent No.: US 7,868,548 B2
(45) Date of Patent: Jan. 11, 2011

(54) PLASMA DISPLAY PANEL AND LOW TEMPERATURE FABRICATION METHOD THEREOF

(75) Inventors: Byeong-Soo Bae, Daejeon (KR); Jeong-Hwan Kim, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 402 days.

(21) Appl. No.: 12/010,255

(22) Filed: Jan. 23, 2008

(65) Prior Publication Data

US 2009/0146564 A1 Jun. 11, 2009

(30) Foreign Application Priority Data

Feb. 28, 2007 (KR) ..... 10-2007-0020498

(51) Int. Cl.
*H01J 17/49* (2006.01)

(52) U.S. Cl. ..... 313/586; 313/582

(58) Field of Classification Search ..... None
See application file for complete search history.

(56) References Cited

U.S. PATENT DOCUMENTS 7,230,376 B2 * 6/2007 Yoo et al. ..... 313/582
2007/0085480 A1 * 4/2007 Ahn ..... 313/582

FOREIGN PATENT DOCUMENTS

| | | | |
|---|---|---|---|
| JP | 9-101653 | A | 4/1997 |
| JP | 9-102273 | A | 4/1997 |
| JP | 9-199037 | A | 7/1997 |
| JP | 9-278482 | A | 10/1997 |
| KR | 10-0495566 | B1 | 2/2004 |
| WO | 01/71761 | A1 | 9/2001 |
| WO | 03/005401 | A1 | 1/2003 |

* cited by examiner

*Primary Examiner*—Ashok Patel
(74) *Attorney, Agent, or Firm*—The Nath Law Group; Jerald L. Meyer; Stanley N. Protigal

(57) ABSTRACT

Disclosed is a plasma display panel fabricated by low temperature process at not more than 300° C. More particularly, the present invention provides a plasma display panel comprising at least one of a dielectric layer in an upper plate, another dielectric layer and barrier ribs in a lower plate, and a sealing material for the upper and lower plates which is prepared of a particular compound obtainable by curing organic monomer, organic oligomer or siloxane based oligomer having polymerizable functional groups; and, in addition, a method for fabrication of the plasma display panel.

7 Claims, 1 Drawing Sheet

PLASMA DISPLAY PANEL AND LOW TEMPERATURE FABRICATION METHOD THEREOF

This application claims priority to Korean Patent Application No. 10-2007-0020498, filed on Feb. 28, 2007, in the Korean Intellectual Property Office, the entire contents of which are hereby incorporated by reference.

BACKGROUND OF THE INVENTION

1. Field of the Invention

The present invention relates to plasma display panels and fabrication methods thereof, more particularly, to a method for fabrication of plasma display panel with high yield, improved reliability and reduced production cost, comprising low temperature firing process at not more than 300° C. to inhibit deformation of a substrate during processing, so as to fabricate large panels and simplify fabricating steps for the same and, in addition, a plasma display panel fabricated by the same.

2. Description of the Related Art

A plasma display panel generally has an upper plate and a lower plate combined together parallel to each other at constant interval, both of which play a role of displaying images.

There are a plurality of sustain electrodes arranged parallel to one another in the upper plate, each of which comprises a transparent electrode made of, for example, ITO (Indium Tin Oxide) and a bus electrode made of metal materials such as Ag arranged on the transparent electrode. Such sustain electrode is covered by a dielectric layer for restricting discharge current and insulating electrode pairs and further has a MgO deposited protective layer in order to improve discharge conditions over the dielectric layer.

Alternatively, the lower plate has barrier ribs arranged parallel to one another in form of stripes (or walls) to fabricate a number of discharge spaces called cells, as well as a plurality of address electrodes arranged parallel to the barrier ribs to implement address discharge at sites crossed with the sustain electrodes so as to emit vacuum ultraviolet (UV). Before fabricating the barrier ribs, a dielectric layer is formed on top of the address electrode by a firing process. Within the barrier ribs at top of the lower plate, a R.G.B fluorescence layer is applied to emit visible light for image displaying.

After sealing such fabricated upper and lower plates together using a sealing material, the discharge space is cleared of residual impurities through heat exhaustion and in return filled with gas to generate plasma, thereby completing production of the plasma display panel.

However, since conventionally known processes for fabrication of plasma display panels have often employed paste materials or a slurry type of glass frit as dielectric material, barrier rib material and/or sealing material, the processes require high firing temperature in the range of 500 to 600° C. to cure any of the above materials. In case of not using Pb as a representative softening material, the firing temperature must be raised. Such process with high temperature heat history has problems in that it causes alteration of glass dimension, pattern deviation leading to defect of display panels, and/or difficulties in enlargement of panel screen, and the like. Therefore, PDP substrates for supporting the barrier ribs must be made of special glass without softening at high temperature.

For a transparent dielectric substance for the plasma display panel, a glass paste for the dielectric substance comprises $PbO—B_2O_3—SiO_2$ based glass powder containing excess of PbO, filler, organic solvent and polymer resin. In this case, the plasma display panel is fabricated by forming a thick film on a glass plate by a screen printing process and firing the laminate at high temperature of 500 to 600° C. In order to form a dielectric film with high light transmission properties in the plasma display panel, it is very important to eliminate foam contained in the dielectric film and it is necessary to control composition, particle diameter, production conditions and/or firing conditions of glass powder in detail.

Dielectric strength property of a dielectric substance in a plasma display panel is an essential element in driving the display panel and, if the substance is formed of glass paste, the dielectric strength is decreased due to foam generated according to sintering conditions and/or surface conditions of glass powder of the glass paste. Metallic Pb remaining in the dielectric film after firing reduces the dielectric strength of a dielectric layer and, in turn, decreases performance of the dielectric substance.

For a process for fabrication of plasma display panel using glass frit which mainly comprises low melting point glass, it is difficult to produce a transparent dielectric substance having low temperature firing properties without addition of excess Pb. Also, low melting point glass pastes need high firing temperature in the range of 550 to 580° C. A heat history process at more than 500° C. has drawbacks such as alteration of glass dimension, pattern distortion leading to defect of display panels, and/or difficulties in enlargement of panel screen.

In case of low melting point glass mainly comprising Pb ingredient, the glass generates high current during discharging to raise power output of an electric device. Pb is widely known as one of environmental pollutants and may cause increase of expenses for treatment of environmental pollution and wastes, especially, if large quantities of waste materials are generated, for example, during formation of barrier ribs in a lower plate of a plasma display panel.

Japanese Patent Laid-Open No. H9-199037 and H9-278482 disclosed $Na_2O—B_2O_3—SiO_2$ based glass with softening point of 500 to 600° C. and $Na_2O—B_2O_3—ZnO$ based glass free of Pb ingredient. Such glasses may further contain softening point lowering ingredients comprising alkali metal oxides such as sodium oxide $Na_2O$, potassium oxide $K_2O$, lithium oxide $Li_2O$, etc. and may implement firing of a dielectric layer at relatively lower temperature. However, when a glass material containing the softening point lowering ingredients is used to prepare a dielectric layer, the glass material potentially causes yellowing of the dielectric layer or a front glass plate and has a relatively higher firing temperature of above 500° C., therefore, is restricted in application for typical substrates such as low price soda-lime glass substrates or thin metal substrates.

International Patent Application No. PCT-JP2002-006666 disclosed a method for yellowing reduction of $Na_2O—B_2O_3—SiO_2$ based glass and/or $Na_2O—B_2O_3—ZnO$ based glass and proposed zinc oxide, boron oxide, lithium oxide, sodium oxide, potassium oxide, rubidium oxide, cesium oxide, copper oxide, silver oxide, manganese oxide(IV), cerium oxide(IV), tin oxide(IV), antimony oxide(IV) and the like as constitutional ingredients of dielectric materials, all of which have firing temperatures of not less than 500° C.

Although formation of a dielectric layer using low melting point glass paste commonly adopts a screen printing process, this requires a very complicated process since the printing process is repeated two or more times to increase thickness of a film. Especially, as a barrier rib in a lower plate for a plasma display panel requires a thicker film than that of a dielectric layer, the barrier rib can be formed by repeating the printing process about eight (8) times. However, as a film fabricated using a glass paste has surface planarity altered depending on firing conditions, careful attention must be taken during the film fabrication process. In order to overcome shortcomings of the screen printing process, Japanese Patent Laid-Open No. H9-102273 disclosed a PDP fabrication process comprising the steps of: applying a glass paste composition to a supporting film to prepare a coating film; drying the coating film to form a film formation material layer; transferring the material layer formed on the supporting film to surface of a glass substrate on which electrodes are fixed; and firing the transferred material layer, thereby forming a dielectric layer on the surface of the glass substrate (that is, dry film formation process). However, although a lithographic process using a dry film can simplify processing steps of the PDP fabrication method, this adopts common low melting point glass pastes and still involves possible defects of dielectric material such as alteration of surface planarity depending on firing conditions.

International Patent Application No. PCT-JP2001-02289 and Korean Patent Application No. 2002-46902 suggested a dielectric composition and/or barrier rib composition which can be fired at relatively low temperature and comprises silicon resin and inorganic-organic combination, compared to typical low melting point glass containing Pb ingredients. Both of these patents proposed a variety of processes for fabrication of dielectric substances including such as spin coating, bar coating and/or painting process other than conventional printing process. In addition, these have advantages of excellent applicability in lithography using the dry film and reduction of dielectric strength caused by foam during the firing process. If silicon resin or inorganic-organic combination is contained in the dielectric composition, the dielectric composition can solve existing problems including environmental pollution caused by Pb ingredient, functional deterioration of dielectrics, high power consumption caused by high dielectric constant, minute dimensional deformation caused by high firing temperature, restriction of substrates and so on. In particular, a low temperature firing process enables low temperature substrates and/or thin substrates to be used, inhibits deformation of substrates to result in manufacturing of large panels and simplifies processes for fabrication of display panels, thereby accomplishing fabrication of low price PDPs with high yield and excellent reliability.

Barrier rib materials used in lower plates of plasma display panels are generally manufactured by adding white and black pigments to dielectric materials useful for front substrates of the display panels. Different processes for fabrication of barrier ribs in various forms have been proposed on the basis of compositions of the dielectric materials. For a 42-inch panel, a dielectric layer with height equal to overall height of a barrier rib is normally formed by a screen printing process and structure of the barrier rib is usually formed by a sandblasting process. In contrast, with regard to fabrication of HDTV grade of plasma display panels with dimension of more than 60-inch, the screen printing process through multi-printing or sandblasting process is not suitable for manufacturing complicated structures with precise dimensions because these panels need smaller pitch between structures and high flatness of structure. In order to solve problems in relation to complexity of such process caused by complicated multi-screen printing as well as formation of uniform barrier rib dielectric bodies, Japanese Patent Laid-Open Nos. H9-102273 and H9-101673 proposed formation of barrier rib layers in a single process using a transfer film (that is, a complex film which comprises a film formation material layer obtained from a glass paste composition and a supporting film, and a cover film easily detachably laminated on top of the material layer). But, this method also has drawbacks such as restriction of substrates made of low melting point fired glass, difficulties in formation of microfine patterns, surface planarity and/or generation of environmental wastes, although it can simplify fabrication processes.

Therefore, in order to produce high resolution plasma display panels with large screen area using low price substrates, there are still a requirement for development of a novel material that has large thickness and enables formation of microfine patterns, which is prepared in a single process, as well as a low temperature firing process of barrier rib.

For general fabrication of a plasma display panel, glass is used as a sealing material to combine and seal an outline of upper and lower plates of the panel after overlapping the upper and lower plates. During sealing the outline of the upper and lower plates, the sealing material must have firing point reduced as much as possible to protect characteristics of barrier ribs, fluorescence layers and/or dielectric layers which were already formed in the panel.

Glass based sealing compositions for plasma display panel conventionally known in the related art are mainly prepared from $PbO—B_2O_3$ or $PbO—ZnO—B_2O_3$ materials. Illustrative examples of the compositions include LS-0118, LS-0206, GA-0951, LS-7201, LS-7105, etc. having firing points in the range of 340 to 400° C., which are available from NEG, Japan.

However, since the above compositions contain PbO ingredients harmful to human body, these adversely affect ecosystems through environmental pollution and/or degradation of natural ecosystems during disposal of products containing the compositions.

SUMMARY OF THE INVENTION

Accordingly, the present invention is directed to solve problems of conventional methods as described above and, an object of the present invention is to provide a plasma display panel comprising an upper plate having a dielectric layer and a lower plate having another dielectric layer and barrier ribs which are sealed together by polymerizing and curing both of the plates at below 300° C. without requiring Pb ingredient.

Another object of the present invention is to provide a method for fabrication of plasma display panel which enables low temperature substrates with thin thickness to be used, inhibits deformation of substrates during processing to result in fabrication of large panels and simplifies fabrication steps of the panels so as to achieve high yield, improved reliability and reduced production cost. In addition, the present invention provides a plasma display panel fabricated by the fabrication method according to the present invention.

In order to achieve the objects described above, the present invention provides a plasma display panel comprising an upper plate and a lower plate combined with the upper plate. More particularly, the display panel comprises an upper plate having a dielectric layer, a lower plate having a dielectric layer and barrier ribs, and a sealing material to combine together the upper and lower plates. At least one of the dielectric layer in the upper plate, the dielectric layer and the barrier ribs in the lower plate and the sealing material is prepared of a particular compound obtained by curing organic monomer, organic oligomer or siloxane based oligomer having polymerizable functional groups.

According to the present invention, the compound useful for fabricating the plasma display panel is preferably obtainable by adding organic monomer or oligomer having polymerizable functional groups to siloxane based oligomer and curing the mixture.

The method for fabrication of plasma display panel by combination of upper and lower plates according to the present invention comprises formation of at least one of a dielectric layer in an upper plate, another dielectric layer and barrier ribs in a lower plate, and a sealing material for the upper and lower plates by curing organic monomer, organic oligomer or siloxane based oligomer having polymerizable functional groups.

The method for fabrication of plasma display panel according to the present invention preferably comprises formation of at least one of a dielectric layer in an upper plate, another dielectric layer and barrier ribs in a lower plate, and a sealing material for the upper and lower plates by adding organic monomer or organic oligomer having polymerizable functional groups to siloxane based oligomer, and curing the mixture to form a three-dimensional network structure.

BRIEF DESCRIPTION OF THE DRAWINGS

These and other objects, features, aspects, and advantages of the present invention will be more fully described in the following detailed description of preferred embodiments and examples, taken in conjunction with the accompanying drawings. In the drawings.

DETAILED DESCRIPTION OF THE INVENTION

Figure 1:
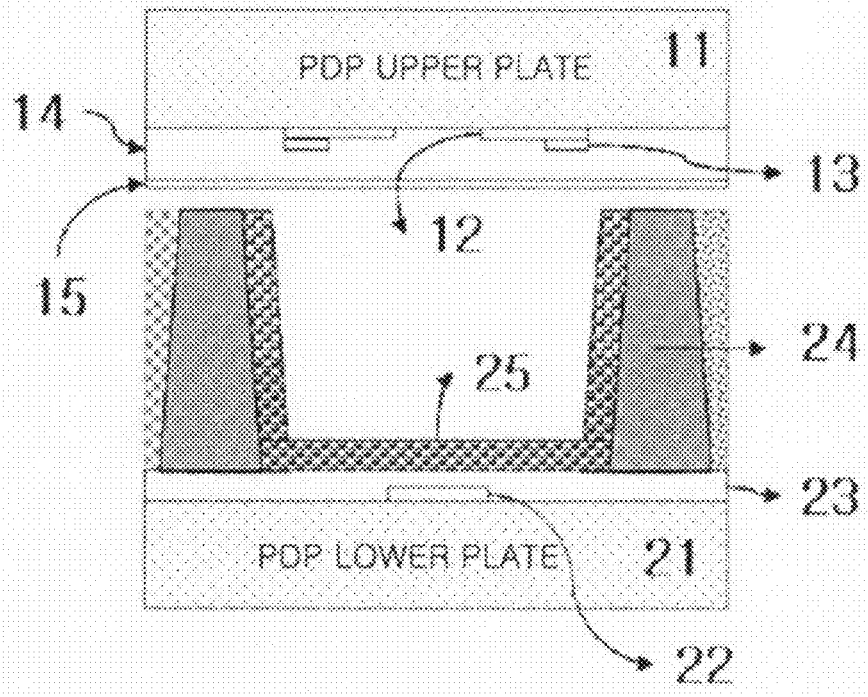
FIG. 1 is a cross-sectional view showing structure of a plasma display panel which comprises upper and lower plates formed using soda-lime glass substrates according to an embodiment of the present invention.
Figure 2:
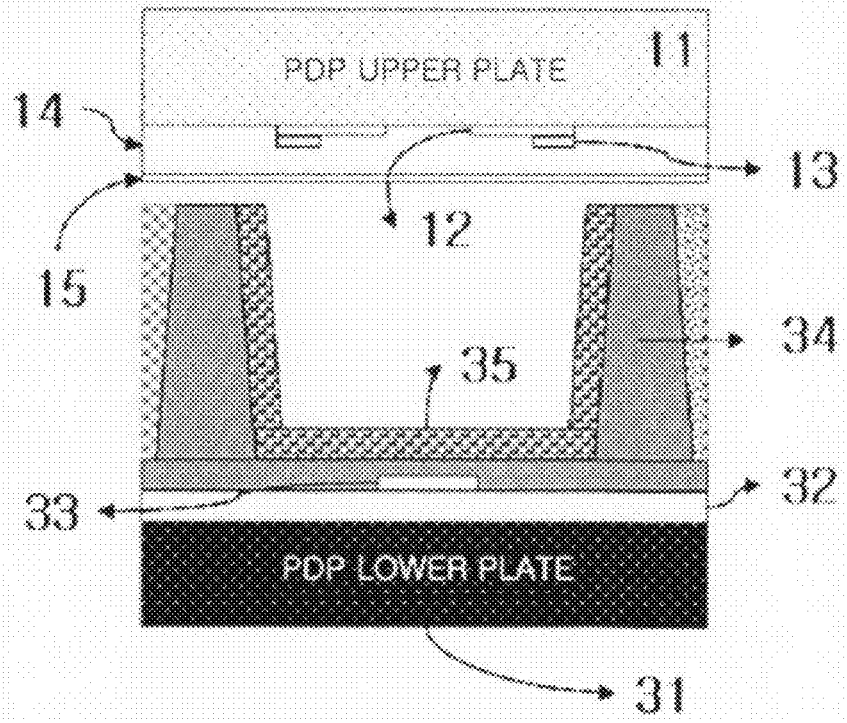
FIG. 2 is a cross-sectional view showing structure of a plasma display panel which comprises an upper plate made of a soda-lime glass substrate and a lower plate made of stainless steel according to another embodiment of the present invention.

Hereinafter, the present invention will be described in detail.

A PDP (Plasma display panel) of the present invention is fabricated by combining together an upper plate and a lower plate, which comprises at least one of a dielectric layer in an upper plate, another dielectric layer and barrier ribs in a lower plate, and a sealing material for the upper and lower plates prepared by polymerizing and curing organic monomer, organic oligomer or siloxane based oligomer having polymerizable functional groups at 300° C. or less, preferably 25° C. to 300° C.

The organic monomer or the organic oligomer means compounds having polymerizable functional groups that include functional groups such as halogen atom, or hydroxy, glycidoxy, amine, vinyl, epoxy, (meth)acryl, amino and mercapto, ciano, substituted amino, nitro and/or imide group in structure thereof. Such organic monomer may be polymerized into a polymer.

The siloxane based oligomer used in the present invention has molecular weight of less than 10,000, preferably 100~10,000, and is preferably modified oligomer with polymerizable functional groups. At least one of the above compounds can be polymerized and cured at 300° C. or less, preferably 25° C. to 300° C. to form a three-dimensional network structure.

According to the present invention, the organic oligomer has molecular weight of less than 10,000, preferably 100~10,000, and includes novolac type epoxy oligomer (e.g. trade name KBPN-115 available from Kukdo Chemical Co., Korea), the siloxane based oligomer includes organic modified siloxane based oligomer such as cycloepoxy oligosiloxane (e.g. Hybrimer ED, KAIST, Korea), methacryl oligosiloxane (e.g. Hybrimer MD, KAIST, Korea), epoxy-amine combined oligosiloxane (eg. Hybrimer GAD, KAIST, Korea), etc.

If necessary for polymerization of raw materials described above, additives such as initiator or curing agent can be further used. Illustrative examples of the curing agent include: phenol novolac type oligomer, bisphenol-A novolac type oligomer or cresol novolac type oligomer based curing agent; dicyandiamide or amine based curing agent; and acid anhydride based monomer curing agent such as phthalic acid anhydride, etc. These can be added in a ratio by equivalent of 0.5 to 2 to epoxy ingredient.

Illustrative examples of the initiator include 2-phenylimidazol, methylimidazol, triphenylphosphine, hydroxyl-cyclohexylphenylketone, 2,2-dimethoxy-2-phenylacetophenone, benzophenone and/or phenyl-2-hydroxy-2-propylketone, etc. These can be added in a ratio by weight of 0.5 to 5 wt. % to epoxy and acryl ingredients.

The mixture of organic monomer or organic oligomer and siloxane based oligomer can form a three-dimensional network structure through curing and, in case of curing siloxane based oligomer modified with polymerizable functional groups, the organic monomer and/or the organic oligomer may be added in the range of 0 to 50 wt. % relative to total weight of the mixture.

The organic monomer or oligomer used in the present invention includes, but is not particularly limited to, bisphenol-A, bisphenol-F, butanediol diglycidylether, 1,2-epoxy-3-phenoxypropane, butylglycidylether, pentadienediepoxide, ethyleneglycol diglycidylether, trimethylolethane, triglycidylether, 1,2,7,8-diepoxyethane, cinenedioxide, bis(3-glycidyloxy)tetramethyldisiloxane, 2,3-epoxypropyl-4-(2,3-epoxypropoxy)benzoate, 1,4-bis(2'3'-epoxypropyl)octafluoro-N-butane, bis[4-(2,3-epoxy-propyldio)phenyl]-sulfide, 1,6-hexanedioldiacrylate, tripropyleneglycoldiacrylate, trimethylpropanetriacrylate, pentaerythritoltetraacrylate, 2-hydroxyethylacrylate, 2-hydroxyethylmethacrylate, hydroxypropylacrylate, hydroxypropylmethacrylate, hydroxybutylacrylate, and hydroxybutylmethacrylate and so on.

The barrier rib may further contain white pigment to improve reflectance.

The upper and lower plates are preferably made of soda-lime glass substrates with lower softening point and economic benefit. In case of the lower plate, metal substrates with good thermal conductivity can be used to facilitate releasing of heat generated during plasma discharge.

The upper plate has a number of display electrode pairs (bus electrode and sustain electrode) in a stripe form on a plane of the upper plate made of soda-lime glass substrate, an upper dielectric film and a protective film laminated on the electrode pairs to cover the same. The dielectric film is formed by applying a dielectric material to the plate and curing the material at not more than 300° C.

Meanwhile, the lower plate has a number of address electrodes in a stripe form on a plane of the lower plate made of soda-lime glass substrate or metal substrate, a lower dielectric film laminated on the address electrodes to coat the same, barrier ribs between the address electrodes on the lower dielectric film, and a fluorescence film applied to top of the lower dielectric film and sides of the barrier ribs. The lower dielectric film is formed by applying a dielectric material to the plate and curing the material at not more than 300° C. The barrier ribs have discharge spaces and are formed by curing the same at not more than 300° C.

The upper and lower plates are arranged parallel to each other through the barrier ribs at constant interval. Discharge cells are formed at sites on which the display electrode pairs are crossed with the address electrodes in three-dimensions. The upper and lower plates are combined and sealed together by dispensing a sealing material to either of the plates, curing the material at not more than 300° C. and removing unreacted organic materials out of the sealing material.

With regard to the present inventive PDP, wall charge is accumulated by applying voltage to the bus electrodes and the address electrodes in the discharge cells to be lit up during driving for address discharge thereof, and sustain pulses are alternately applied to the bus electrodes and the sustain electrodes. As a result, the discharge cells with the address discharge can selectively generate the sustain discharge and emit light, thereby displaying images.

Hereinafter, the present invention will be more particularly described by the preferred examples with reference to the accompanying drawings. However, these are intended to illustrate the invention as preferred embodiments of the present invention and do not limit the scope of the present invention.

EXAMPLE 1

FIG. 1 is a cross-sectional view schematically illustrating construction of PDP as described in Example 1 of the present invention, which partially shows a display cell of PDP.

The PDP generally has an upper plate and a lower plate, which are combined together after separately manufacturing the plates.

The upper plate has a number of display electrode pairs (bus electrode 13 and sustain electrode 12) in a stripe form on a plane of the upper plate made of soda-lime glass substrate 11, an upper dielectric film 14 and a protective film 15 laminated on the electrode pairs to cover the same.

Meanwhile, the lower plate has a number of address electrodes 22 in a stripe form on a plane of the lower plate made of soda-lime glass substrate 21, a lower dielectric film 23 laminated on the address electrodes 22 to coat the same, barrier ribs 24 between the address electrodes 22 on the lower dielectric film 23, and a fluorescence film 25 applied to top of the lower dielectric film 23 and sides of the barrier ribs 24.

The upper and lower plates are arranged parallel to each other through the barrier ribs 24 at constant interval. Discharge cells are formed at sites on which the display electrode pairs 12 and 13 are crossed with the address electrodes 22 in three-dimensions.

For this PDP, wall charge is accumulated by applying voltage to the bus electrodes 13 and the address electrodes 22 to generate address discharge in the discharge cells to be lit up during driving the PDP, then, sustain pulses are alternately applied to the bus electrodes 13 and the sustain electrodes 12. As a result, the discharge cells with the address discharge can selectively generate the sustain discharge and emit light, thereby displaying images.

Fabrication of the PDP will be described in detail as follows:

The upper plate is fabricated by the following procedures.

An upper dielectric film 14 was formed by heating and curing a dielectric material at 150 to 300° C. on top of a sodium-lime glass electrode substrate 11 patterned with a transparent ITO electrode 12 and a bus electrode 13. The dielectric material was prepared by mixing novolac oligomer KBE-F4113 (Kolon Chemical Co., Korea) as a curing agent with novolac epoxy oligomer KBPN-115 (Kukdo Chemical Co., Korea) in 1.0 ratio by equivalent to the epoxy oligomer, and adding 2-phenylimidazol (Aldrich, USA) as an initiator to the mixture in 1.0% by weight to the epoxy oligomer to form a three-dimensional network structure.

Continuously, a protective film 15 made of MgO was formed on the upper dielectric film 14 by means of a sputtering process.

The lower plate is fabricated by the following procedures.

A lower dielectric film 23 was formed by heating and curing a dielectric material at 200° C. on top of a sodium-lime glass electrode substrate 21 patterned with an address electrode 22. The dielectric material was prepared by mixing novolac oligomer KBE-F4113 (Kolon Chemical Co., Korea) as a curing agent with novolac epoxy oligomer KBPN-115 (Kukdo Chemical Co., Korea) in 1.0 ratio by equivalent to the epoxy oligomer, adding 2-phenylimidazol (Aldrich, USA) as an initiator to the mixture in 1.0% by weight to the epoxy oligomer to prepare the upper dielectric material, and further adding 30 wt. % of titania COTIOX R-730 (Cosmo Chemical Co., Korea) as an inorganic pigment to the upper dielectric material.

In a continuous manner, barrier ribs 24 were formed simultaneously between two or more of address electrodes 22 on the lower dielectric film 23 by means of a molding process. The barrier ribs 24 were prepared of epoxy material containing titania, which was the same as that used in formation of the lower dielectric film 23, by heating and curing the epoxy material at 250° C.

Next, a fluorescence film 25 was formed in a space between the barrier ribs 24 by arranging red, green and blue fluorescent materials in order, applying each of the materials by means of a screen printing process, and drying and firing the coatings at 300° C. The fluorescence film may further contain acryl resin as an organic binder to decrease burn-out temperature.

The fabricated upper and lower plates were combined together to result in the proposed PDP. The upper and lower plates were sealed by dispensing Duralco™ 4703 (Cotronics Co., USA) as a sealing material around outside of either of the upper plate or the lower plate, combining together both of the plates and curing the combined plates at 300° C.

An internal space between the plates was evacuated to form a high vacuum condition up to $10^{-3}$ Pa, then, filled with a combined discharge gas under appropriate pressure to complete PDP fabrication.

EXAMPLE 2

In this example, construction of PDP is substantially identical to that as described in Example 1 and PDP fabrication will be described in detail as follows:

The upper plate is fabricated by the following procedures.

An upper dielectric film 14 was formed by heating and curing a dielectric material at 180 to 250° C. on top of a sodium-lime glass electrode substrate 11 patterned with a transparent ITO electrode 12 and a bus electrode 13. The dielectric material was prepared by mixing novolac oligomer KBE-F4113 (Kolon Chemical Co., Korea) as a curing agent with epoxy oligosiloxane oligomer Hybrimer GD (KAIST., Korea) in 1.0 ratio by equivalent to the epoxy oligomer, and adding 2-phenylimidazol (Aldrich, USA) as an initiator to the mixture in 1.0% by weight to the epoxy oligomer to form a three-dimensional network structure. The above dielectric material further contained 30 wt. % of butanediol diglycidylether as epoxy monomer to assist curing of the dielectric material.

Continuously, a protective film 15 made of MgO was formed on the upper dielectric film 14 by means of a sputtering process.

The lower plate is fabricated by the following procedures.

A lower dielectric film 23 was formed by pre-curing a dielectric material through UV radiation with 200 mJ of energy (by a Hg lamp) on top of a sodium-lime glass electrode substrate 21 patterned with an address electrode 22, then, heating and curing the pre-cured material at 200° C. The dielectric material was prepared by mixing UV-6976 (Dow Chem., USA) as an initiator with cycloepoxy oligosiloxane Hybrimer ED (KAIST, Korea) in a ratio of 2.0 wt. % to the epoxy oligosiloxane to prepare the upper dielectric material, and further adding 30 wt. % of titania COTIOX R-730 (Cosmo Chemical Co., Korea) as an inorganic pigment to the upper dielectric material.

In a continuous manner, barrier ribs 24 were formed by shaping the barrier ribs simultaneously between two or more of address electrodes 22 on the lower dielectric film 23 by means of a molding process, radiating UV with 2000 mJ of energy (by the Hg lamp) to the shaped barrier ribs to pre-cure the barrier ribs, and heating and curing the pre-cured barrier ribs at 250° C. The barrier ribs 24 were prepared of diphenyl cycloepoxy material containing titania, which was the same as that used in formation of the lower dielectric film 23, by heating and curing the epoxy material at 250° C.

Next, a fluorescence film 25 was formed in a space between the barrier ribs 24 by arranging red, green and blue fluorescent materials in order, applying each of the materials by means of a screen printing process, and drying and firing the coatings at 300° C. The fluorescence film may further contain acryl resin as an organic binder to decrease burn-out temperature.

The fabricated upper and lower plates were combined together to result in the proposed PDP. The upper and lower plates were sealed by dispensing Duralco™ 4703 (Cotronics Co., USA) as a sealing material around outside of either of the upper plate or the lower plate, combining together both of the plates and curing the combined plates at 300° C.

An internal space between the plates was evacuated to form a high vacuum condition up to $10^{-3}$ Pa, then, filled with a combined discharge gas under appropriate pressure to complete PDP fabrication.

EXAMPLE 3

Construction of PDP in this example is similar to that in Example 1, except that the lower plate was made of stainless steel substrate 31 instead of the soda-lime glass substrate 21 in order to play a further role of heat sink.

Materials and procedures for fabrication of the upper plate are same as described in Example 2.

The lower plate is fabricated by the following procedures.

A lower dielectric film 32 was formed by pre-curing a dielectric material through UV radiation with 2000 mJ of energy (by a Hg lamp) after applying the dielectric material to top of a stainless steel substrate 31, then, heating and curing the pre-cured material at 200° C. The dielectric material was prepared by mixing UV-6976 (Dow Chem., USA) as an initiator with cycloepoxy oligosiloxane Hybrimer ED (KAIST, Korea) in a ratio of 2.0 wt. % to the epoxy oligosiloxane to prepare first dielectric material, and further adding 30 wt. % of titania COTIOX R-730 (Cosmo Chemical Co., Korea) as an inorganic pigment to the first dielectric material.

An address electrode 33 was formed on the dielectric film 32 by applying silver sol in a stripe form to the dielectric film 32 by means of an ink-jet process, then, heating and curing the coated film at 300° C. to complete the address electrode 33.

In a continuous manner, barrier ribs 34 were formed by shaping the barrier ribs simultaneously between two or more of address electrodes 33 on the lower plate by means of a molding process, radiating UV with 2000 mJ of energy (by the Hg lamp) to the shaped barrier ribs to pre-cure the barrier ribs, and heating and curing the pre-cured barrier ribs at 250° C. The barrier ribs 24 were prepared of diphenyl cycloepoxy material containing titania, which was the same as that used in formation of the lower dielectric film 32, by heating and curing the epoxy material at 250° C.

Next, a fluorescence film 35 was formed in a space between the barrier ribs 34 by arranging red, green and blue fluorescent materials in order, applying each of the materials by means of a screen printing process, and drying and firing the coatings at 300° C. The fluorescence film may further contain acryl resin as an organic binder to decrease burn-out temperature.

The fabricated upper and lower plates were combined together to result in the proposed PDP. The upper and lower plates were sealed by dispensing Duralco™ 4703 (Cotronics Co., USA) as a sealing material around outside of either of the upper plate or the lower plate, combining together both of the plates and curing the combined plates at 300° C.

An internal space between the plates was evacuated to form a high vacuum condition up to $10^{-3}$ Pa, then, filled with a combined discharge gas under appropriate pressure to complete PDP fabrication.

Results of a driving experiment for PDPs fabricated according to all of the examples are shown in the following Table 1.

TABLE 1

Results of driving experiments

| | Luminance | Driving voltage | |
|---|---|---|---|
| | | First on | Full on |
| Example 1 | 450 cd/m$^2$ | 180 V | 260 V |
| Example 2 | 450 cd/m$^2$ | 160 V | 240 V |
| Example 3 | 350 cd/m$^2$ | 185 V | 270 V |

As described above, the present invention can fabricate plasma display panels with high yield, improved reliability and reduced production cost, by conducting full processes for fabrication of the panels at not more than 300° C. to enable low temperature thin substrates to be used, inhibit deformation of substrates during processing, so as to fabricate large panels and simplify fabrication fabricating steps for the same.

While the present invention has been described with reference to the preferred examples, it will be understood by those skilled in the art that various modifications and variations may be made therein without departing from the scope of the present invention as defined by the appended claims.

What is claimed is:

1. A plasma display panel fabricated by combining together an upper plate and a lower plate, comprising a dielectric layer in an upper plate, another dielectric layer and barrier ribs in a lower plate, and a sealing material for the upper and lower plates, wherein the dielectric layer and the another dielectric layer consist of compounds with a three-dimensional network structure, and wherein the compounds comprise a polymer having repeating units of any one selected from the group consisting of organic monomer, organic oligomer and siloxane based oligomer.

2. The plasma display panel according to claim 1, wherein the panel comprises the compound with three-dimensional network structure which is obtained by adding organic monomer or organic oligomer having polymerizable functional groups to siloxane based oligomer.

3. The plasma display panel according to claim 1, further comprising three-dimensional network structure formed by curing the compound at less than 300° C.

4. The plasma display panel according to claim 1, further comprising the functional groups comprise at least one selected from a group consisting of halogen atom, hydroxy, glycidoxy, amine, vinyl, epoxy, (meth)acryl, amino and mercapto, ciano, substituted amino, nitro and imide group.

5. The plasma display panel according to claim 2, wherein the oligomer has molecular weight of at less than 10,000.

6. The plasma display panel according to claim 1, wherein the barrier rib comprises white pigment.

7. The plasma display panel according to claim 1, wherein the upper or lower plate comprises low temperature glass plate containing soda-lime glass or metal plate.

* * * * *